US009711832B2

(12) United States Patent
Liu et al.

(10) Patent No.: US 9,711,832 B2
(45) Date of Patent: Jul. 18, 2017

(54) HARMONIC OSCILLATOR AND CAVITY FILTER AND ELECTROMAGNETIC WAVE DEVICE THEREOF

(71) Applicant: KUANG-CHI INNOVATIVE TECHNOLOGY LTD., Shenzhen (CN)

(72) Inventors: Ruopeng Liu, Shenzhen (CN); Guanxiong Xu, Shenzhen (CN); Jingjing Liu, Shenzhen (CN); Ning Xu, Shenzhen (CN)

(73) Assignee: KUANG-CHI INNOVATIVE TECHNOLOGY LTD., Shenzhen (CN)

( * ) Notice: Subject to any disclaimer, the term of this patent is extended or adjusted under 35 U.S.C. 154(b) by 126 days.

(21) Appl. No.: 14/716,830

(22) Filed: May 19, 2015

(65) Prior Publication Data

US 2015/0255844 A1 Sep. 10, 2015

Related U.S. Application Data

(63) Continuation of application No. PCT/CN2013/084835, filed on Oct. 8, 2013.

(30) Foreign Application Priority Data

Nov. 20, 2012 (CN) ..... 2012 1 0472200

(51) Int. Cl.
*H01P 5/12* (2006.01)
*H01P 1/20* (2006.01)
(Continued)

(52) U.S. Cl.
CPC ..... *H01P 1/2002* (2013.01); *H01P 7/06* (2013.01); *H01P 7/10* (2013.01)

(58) Field of Classification Search
CPC ..... H01P 1/2002; H01P 7/06; H01P 7/10
(Continued)

(56) References Cited

U.S. PATENT DOCUMENTS

2010/0301971 A1* 12/2010 Yonak ..... H01P 1/20381 333/219.1

FOREIGN PATENT DOCUMENTS

CN 201022191 Y 2/2008
CN 202275920 U 6/2012
(Continued)

OTHER PUBLICATIONS

Ruopeng Liu; Tie Jun Cui; Da Huang; Bo Zhao; and David R. Smith, Description and explanation of electromagnetic behaviors in artificial metamaterials based on effective medium theory, Physical Review, DOI: 10.1103/PhysRevE.76.026606.

*Primary Examiner* — Robert Pascal
*Assistant Examiner* — Kimberly Glenn
(74) *Attorney, Agent, or Firm* — Perkins Coie LLP

(57) ABSTRACT

The present application relates to a harmonic oscillator. The harmonic oscillator includes a dielectric body and at least one responding unit attached onto a surface of the dielectric body, where the responding unit is a conductive structure having a geometrical pattern. The application further relates to a cavity filter having the harmonic oscillator and an electromagnetic wave device. By using the harmonic oscillator in the application, a permittivity can be effectively increased and a resonance frequency of a cavity filter can be decreased, thereby implementing miniaturization. Moreover, for an electromagnetic wave in a TM mode, a frequency can be decreased and an electromagnetic loss is not affected.

19 Claims, 7 Drawing Sheets

(51) Int. Cl.
*H01P 7/10* (2006.01)
*H01P 7/06* (2006.01)

(58) Field of Classification Search
USPC ..... 333/134
See application file for complete search history.

(56) References Cited

FOREIGN PATENT DOCUMENTS

| | | | |
|---|---|---|---|
| CN | 202434684 | U | 9/2012 |
| CN | 102723568 | A | 10/2012 |
| CN | 102723570 | A | 10/2012 |
| CN | 102731102 | A | 10/2012 |
| CN | 103022624 | A | 4/2013 |
| CN | 103022625 | A | 4/2013 |
| CN | 202997028 | U | 6/2013 |
| CN | 202997029 | U | 6/2013 |
| JP | 58-204602 | A | 11/1983 |
| JP | 2003133820 | A | 5/2003 |

* cited by examiner

HARMONIC OSCILLATOR AND CAVITY FILTER AND ELECTROMAGNETIC WAVE DEVICE THEREOF

CROSS REFERENCE TO RELATED APPLICATIONS

This application is a continuation of PCT Application No. PCT/CN2013/084835 filed on Oct. 8, 2013, which claims priority to Chinese patent application No. 201210472200.8 filed Nov. 20, 2012, both of which are incorporated herein by reference.

TECHNICAL FIELD

The present application relates to the field of radio frequency devices, and more specifically, to a harmonic oscillator and its cavity filter, and an electromagnetic wave device.

BACKGROUND

A harmonic oscillator, also called a dielectric resonator, has advantages such as a high permittivity and a low electromagnetic loss, and is widely applied in a variety of microwave radio frequency devices, for example, a cavity filter and a duplexer constituted by a cavity filter. Generally, the harmonic oscillator is of a cylinder shape and is formed by a microwave dielectric ceramic by means of integrated sintering.

The microwave dielectric ceramic also has an advantage such as a high permittivity, a low electromagnetic loss, and high withstanding power, and therefore meets a requirement of the harmonic oscillator. However, with the development of science and technology and continuous improvement of product integration, people have an increasing demand for filter and duplexer miniaturization. In the prior art, a volume of a cavity filter and a volume of a duplexer are in inverse proportion to a resonance frequency. If a volume of a resonant cavity of the cavity filter or duplexer is directly reduced, a resonance frequency corresponding to the cavity filter or duplexer will increase, so that a filtering function requirement of the filter cannot be met. How to implement miniaturization without affecting a normal use function of a cavity filter and a duplexer is an issue that needs to be urgently solved now by research and development personnel together.

SUMMARY

An objective of the disclosure is to provide, for the foregoing defect in the prior art, a harmonic oscillator that implements miniaturization and does not affect a resonance frequency or other performance, a cavity filter of the harmonic oscillator, and an electromagnetic wave device.

The disclosure provides a harmonic oscillator, including a dielectric body having a cylindrical surface and at least one responding unit attached onto the cylindrical surface, where the responding unit is a structure that is made from a conductive material and has a geometrical pattern.

In the harmonic oscillator described in the disclosure, the responding unit has a positive equivalent refractive index in an electromagnetic field corresponding to a working frequency of the harmonic oscillator.

In the harmonic oscillator described in the disclosure, there are multiple responding units that are not electrically connected to each other.

In the harmonic oscillator described in the disclosure, the dielectric body has multiple coaxial cylindrical surfaces that are internally and externally nested, where one or multiple responding units are attached onto at least one of the cylindrical surfaces.

In the harmonic oscillator described in the disclosure, the responding unit is located on one or multiple cylindrical surfaces whose diameter is less than a first preset value, where the first preset value is less than or equal to 90% of a sum of a diameter of an outermost cylindrical surface and a diameter of an innermost cylindrical surface in the multiple cylindrical surfaces.

In the harmonic oscillator described in the disclosure, the responding unit is located on one innermost cylindrical surface in the multiple cylindrical surfaces.

In the harmonic oscillator described in the disclosure, dimensions of a responding unit on each cylindrical surface decrease progressively as a diameter of the cylindrical surface increases.

In the harmonic oscillator described in the disclosure, the dielectric body includes multiple cylindrical dielectric cylinders that are internally and externally nested, where an inner surface and outer surface of each dielectric cylinder are both a cylindrical surface, and the responding unit is attached onto an inner surface or outer surface of at least one of the dielectric cylinders.

In the harmonic oscillator described in the disclosure, a working frequency of the harmonic oscillator is lower than a resonance frequency of the responding unit or is higher than a plasma frequency of the responding unit.

In the harmonic oscillator described in the disclosure, dimensions of the responding unit are less than an electromagnetic wave wavelength corresponding to a working frequency of the harmonic oscillator.

In the harmonic oscillator described in the disclosure, dimensions of the responding unit are less than ½ of an electromagnetic wave wavelength corresponding to a working frequency of the harmonic oscillator.

In the harmonic oscillator described in the disclosure, dimensions of the responding unit are less than ⅕ of an electromagnetic wave wavelength corresponding to a working frequency of the harmonic oscillator.

In the harmonic oscillator described in the disclosure, dimensions of the responding unit are less than 1/10 of an electromagnetic wave wavelength corresponding to a working frequency of the harmonic oscillator.

In the harmonic oscillator described in the disclosure, the dielectric body is made from a material with a permittivity greater than 1 and a loss angle tangent value less than 0.1.

In the harmonic oscillator described in the disclosure, the dielectric body is made from a material with a permittivity greater than 10 and a loss angle tangent value less than 0.01.

In the harmonic oscillator described in the disclosure, the dielectric body is made from a material with a permittivity greater than 30 and a loss angle tangent value less than 0.001.

In the harmonic oscillator described in the disclosure, the dielectric body is made from a microwave dielectric ceramic.

In the harmonic oscillator described in the disclosure, the conductive material is a metallic material.

In the harmonic oscillator described in the disclosure, the conductive material is gold, silver, copper, or the conductive material which is an alloy including gold, silver or copper.

In the harmonic oscillator described in the disclosure, the conductive material is a nonmetallic material.

In the harmonic oscillator described in the disclosure, the conductive material is indium-tin-oxide, aluminum-doped zinc oxide, or conducting graphite.

In the harmonic oscillator described in the disclosure, the responding unit is the same or is not completely the same.

In the harmonic oscillator described in the disclosure, the responding unit gradually decreases or increases from two ends to the middle along an axial direction of the cylindrical surface.

In the harmonic oscillator described in the disclosure, the responding unit is an anisotropic structure.

The disclosure further relates to a cavity filter, including a resonant cavity and a harmonic oscillator located within the resonant cavity, where the harmonic oscillator includes a dielectric body having a cylindrical surface and at least one responding unit attached onto the cylindrical surface, where the responding unit is a structure that is made from a conductive material and has a geometrical pattern.

In the cavity filter described in the disclosure, a first mode of the cavity filter is a TM mode, and the responding unit is disposed on one or multiple cylindrical surfaces, where the one or more cylindrical surfaces are formed respectively by extending one or multiple magnetic lines in the TM mode along an electric field direction.

In the cavity filter described in the disclosure, the responding unit of the harmonic oscillator is located on a cylindrical surface whose electric field intensity is between a maximum value of electric field intensity and the maximum value minus 0.5 dB.

In the cavity filter described in the disclosure, the responding unit is located on one or multiple cylindrical surfaces whose diameter is less than a first preset value, where the first preset value is less than or equal to 90% of a sum of a diameter of an outermost cylindrical surface and a diameter of an innermost cylindrical surface in the multiple cylindrical surfaces.

In the cavity filter described in the disclosure, the cavity filter is a band-pass filter, a band-stop filter, a high-pass filter, a low-pass filter, or a multi-band filter.

The disclosure further relates to an electromagnetic wave device, including a signal transmitting module, a signal receiving module, and a cavity filter, where an input end of the cavity filter is connected to the signal transmitting module, an output end of the cavity filter is connected to the signal receiving module, and the cavity filter includes a resonant cavity and a harmonic oscillator located within the resonant cavity, where the harmonic oscillator includes a dielectric body having a cylindrical surface and at least one responding unit attached onto the cylindrical surface, where the responding unit is a structure that is made from a conductive material and has a geometrical pattern.

In the electromagnetic wave device described in the disclosure, the electromagnetic wave device is a base station.

In the electromagnetic wave device described in the disclosure, the base station includes a duplexer, where the duplexer includes a transmitting band-pass filter and a receiving band-pass filter, where at least one of the transmitting band-pass filter and the receiving band-pass filter is the cavity filter.

In the electromagnetic wave device described in the disclosure, the electromagnetic wave device is an airplane, or a radar, or a satellite.

The following beneficial effect is obtained by implementing the harmonic oscillator, the cavity filter of the harmonic oscillator, and the electromagnetic wave device in the disclosure: The harmonic oscillator in the disclosure uses a responding unit to increase a permittivity, which can effectively decrease a resonance frequency of the filter, thereby effectively reducing a volume of the filter in a case of implementing a same resonance frequency. In addition, because the responding unit is attached onto a cylindrical surface, an eddy current loss is effectively reduced and even avoided, thereby avoiding decrease of a Q value due to introduction of a responding unit made from a conductive material.

BRIEF DESCRIPTION OF DRAWINGS

The following further describes the disclosure with reference to accompanying drawings and embodiments. In the accompanying drawings.

DESCRIPTION OF EMBODIMENTS

Figure 1:
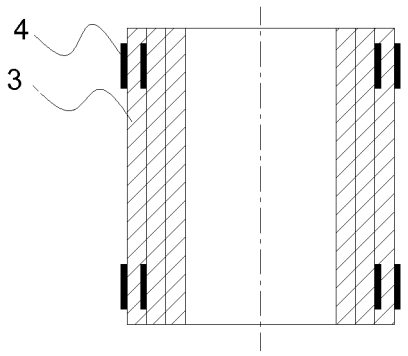
FIG. 1 is a schematic structural diagram of a harmonic oscillator according to Embodiment 1 of the disclosure.

The disclosure relates to a harmonic oscillator, including a dielectric body 3 and at least one responding unit 4, as shown in FIG. 1. Generally, the dielectric body 3 has a through-hole in the middle and thus is ringlike, so that a tuning bolt of a cavity filter is inserted into the through-hole for frequency modulation. There is one or more curved surfaces on an inner surface or outer surface of the dielectric body 3, or between an inner surface of the dielectric body 3 and an outer surface of the dielectric body 3, where the curved surfaces are cylindrical surfaces. The responding unit 4 is disposed on at least one of the cylindrical surfaces.

Figure 2:
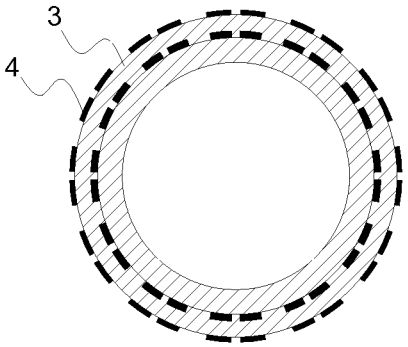
FIG. 2 is a vertical view of a harmonic oscillator according to Embodiment 2.
Figure 3:
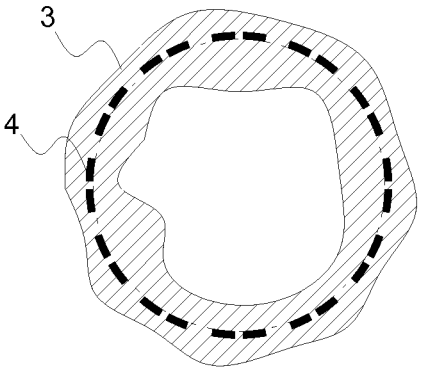
FIG. 3 is a vertical view of a harmonic oscillator according to Embodiment 3.

The cylindrical surface in the specification may be an actual interface, for example, an inner surface or an outer surface. Alternatively, the dielectric body 3 includes a first dielectric cylinder and a second dielectric cylinder that are internally and externally nested, where a contact interface of the first dielectric cylinder and the second dielectric cylinder is a cylindrical surface and the responding unit 4 is attached onto the cylindrical surface, as shown in FIG. 2. The cylindrical surface in the specification may also be a virtually divided cylindrical surface, for example, after the responding unit 4 is prepared on a cylindrical surface where a first dielectric cylinder contacts a second dielectric cylinder, the first dielectric cylinder and the second dielectric cylinder are mixed together by means of hot pressing, firing, or the like, so that an interface of the cylindrical surface disappears but the responding unit 4 is still distributed along one cylindrical surface, as shown in FIG. 3. This case also falls within the protection scope of the disclosure.

A material of the dielectric body 3 especially refers to a material that is applicable to a cavity filter and may be used as a dielectric harmonic oscillator. The material has a high permittivity and a low loss angle tangent value. Under a working frequency of the harmonic oscillator, a permittivity of the material is usually higher than 30 and a loss angle tangent value is lower than 0.001. A common material meeting the requirement is a microwave dielectric ceramic, for example, $BaTi_4O_9$, $Ba_2Ti_9O_{20}$, $MgTiO_3$-$CaTiO_3$, BaO-$Ln_2O_3$-$TiO_2$ series, and $Bi_2O_3$-ZnO—$Nb_2O_5$ series, and the like. Certainly, in addition to the ceramic, another material meeting the requirement may also be used as the dielectric body of the disclosure. In a case that a requirement for miniaturization of a resonant cavity is not high, the dielectric body selects and uses a material with a permittivity greater than 10 and a loss angle tangent value less than 0.01. And even it is required that the material of the dielectric body only be a material with a permittivity greater than a permittivity of air (the permittivity of the air is about 1) and a loss angle tangent value less than 0.1, for example, polytetrafluoroethylene and epoxide resin.

A shape of the dielectric body 3 may be any shape, for example, a quadrangular pillar shape, a circular-ringed shape, and an irregular shape. The shape of the dielectric body is also different according to a different shape of an applied resonant cavity. A shape of any dielectric harmonic oscillator available in the prior art may be used as the shape of the dielectric body 3 in the disclosure. Preferably, the dielectric body 3 is of a regular symmetric structure, for example, a quadrangular pillar shape or a cylinder shape. A commonest shape is a cylinder shape.

The foregoing working frequency of the harmonic oscillator refers to, when the harmonic oscillator is applied in a resonant cavity of one cavity filter or duplexer, a working frequency required by the corresponding cavity filter or duplexer, for example, a resonance frequency of an electromagnetic field corresponding to a respective first mode (a main mode). The resonance frequency is usually equivalent to a resonance frequency of the dielectric body 3 of the harmonic oscillator.

The responding unit 4 is attached onto at least one of the cylindrical surfaces. Specifically, one or more responding units 4 are attached onto any one cylindrical surface. When there are multiple responding units, the multiple responding units are mutually independent responding monomers and are not electrically connected to each other. Each responding unit 4 is a structure that is made from a conductive material and has a geometrical pattern, and may affect an electromagnetic field.

The conductive material in the specification may be metal, for example, silver, copper, or gold; or may be a metal alloy, for example, an alloy including silver, copper or gold, or other alloy having a power conducting capability; or may be conducting nonmetal, for example, conducting graphite, aluminum-doped zinc oxide, or indium-tin-oxide.

In the disclosure, the responding unit 4 is preferably a metal microstructure. To enable the responding unit 4 to have a respective independent electromagnetic response in the electromagnetic field, dimensions of the responding unit 4 should be in a sub-wavelength range, that is, the dimensions are less than an electromagnetic wave wavelength corresponding to the working frequency of the harmonic oscillator and are generally less than ½ of the electromagnetic wave wavelength. Smaller dimensions are recommended. The dimensions are preferably less than ⅕ of the electromagnetic wave wavelength and are optimally less than 1/10 of the electromagnetic wave wavelength.

Figure 4:
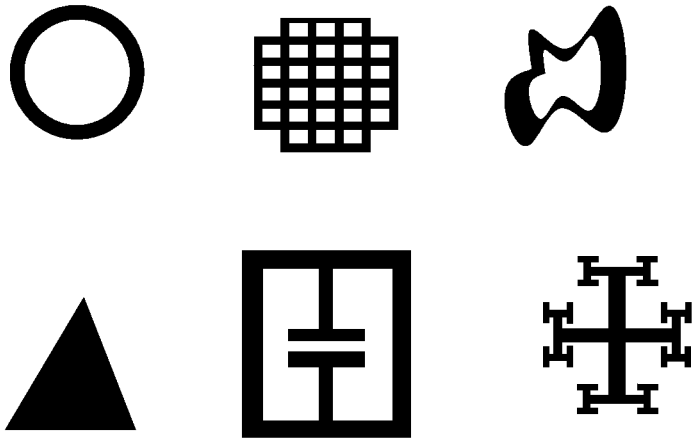
FIG. 4 is a possible planar structure shape of a responding unit before the responding unit is bent as a cylindrical surface according to the disclosure.

Certainly, the responding unit 4 of the harmonic oscillator in the disclosure is not limited to the shape shown in FIG. 1, and may be a three-dimensional structure that is obtained by attaching a planar structure of any shape onto a cylindrical surface and bending the planar structure along the cylindrical surface. The planar structure is of, for example, a solid schistose shape, a hollow ringed or meshed shape, snowflake shape, a tree branch shape, a polygon shape, a circular shape, or any irregular shape. FIG. 4 shows several possible planar shapes of a responding unit.

The responding unit may be randomly arranged on one cylindrical surface. Preferably, the responding unit is arranged on a cylindrical surface according to a certain rule, for example, the responding unit is evenly arranged, around a central axis of the cylindrical surface, on the cylindrical surface in a manner of equally dividing a radius angle, as shown in FIG. 3.

The responding unit may also be arranged on multiple cylindrical surfaces with different radiuses, as shown in FIG. 1. The dielectric body 3 includes multiple coaxial dielectric cylinders that are internally and externally nested. Each dielectric cylinder has an inner cylindrical surface and an outer cylindrical surface. Likewise, various cylindrical surfaces are coaxial and are internally and externally nested. One or more responding units are attached on at least one of the cylindrical surfaces.

A first invention point of the disclosure lies in that the responding unit 4 meeting the foregoing dimension requirement has a positive equivalent refractive index in an electromagnetic field corresponding to the working frequency of the harmonic oscillator.

Figure 5:
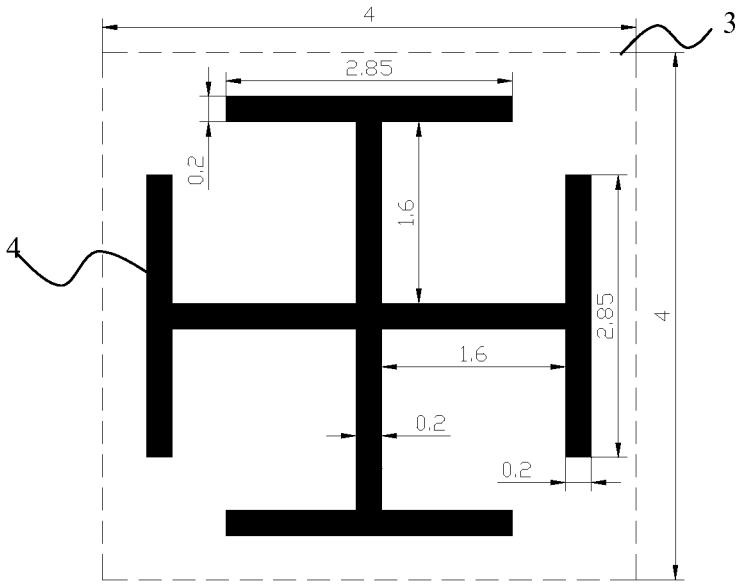
FIG. 5 is a diagram showing specific dimensions of a responding unit.
Figure 6:
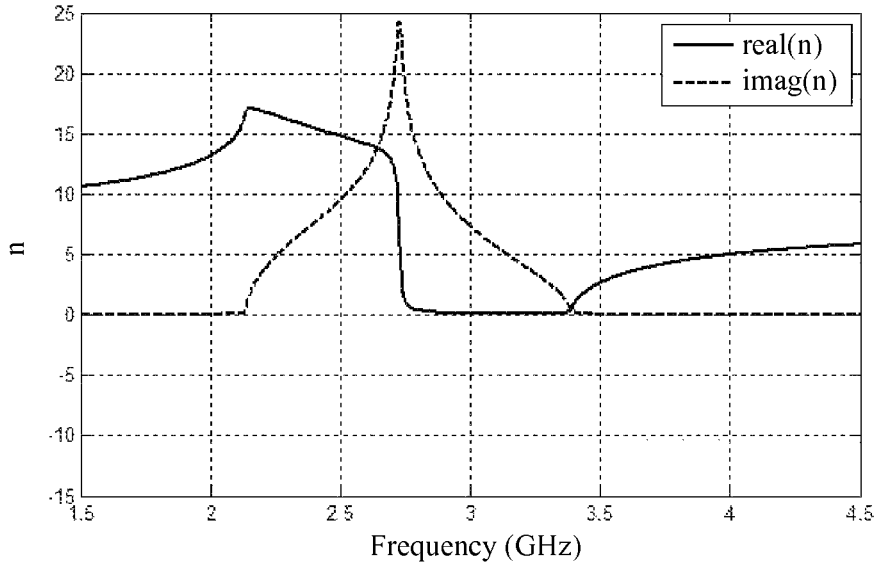
FIG. 6 is a curve showing a relationship between an equivalent refractive index of a responding unit shown in FIG. 5 and a frequency.

An equivalent refractive index of each responding unit 4 is a curve related to a frequency. For any specified responding unit, as shown in FIG. 5, a unit of each label is millimeter (mm), a conductive material is copper foil, and a copper foil thickness is 0.018 mm. A permittivity and loss angle tangent value of a dielectric body onto which the responding unit is attached are limited and a certain thickness, for example, 2 mm, is taken. The responding unit and its dielectric body are simulated by using simulation software, and a curve showing a relationship between an equivalent refractive index of the responding unit and a frequency is obtained, as shown in FIG. 6. For a more specific algorithm for an equivalent refractive index of a responding unit, reference may be made to a thesis *Description and explanation of electromagnetic behaviors in artificial metamaterials based on effective dielectric theory* prepared by Ruopeng Liu, Tie Jun Cui, Da Huang, Bo Zhao, and David R. Smith, and issued in 2007.

It may be known from FIG. 6 that the equivalent refractive index of the responding unit is a positive value within an entire band range, and therefore the responding unit may be used in the harmonic oscillator in the disclosure.

Figure 7:
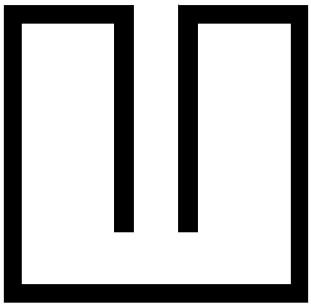
FIG. 7 is a schematic structural diagram of another responding unit.
Figure 8:
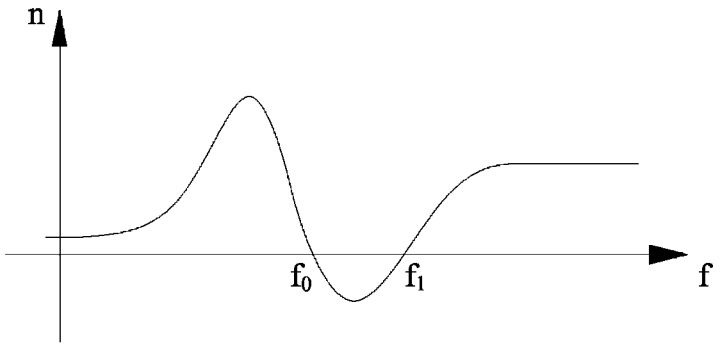
FIG. 8 is a curve showing a relationship between an equivalent refractive index of a responding unit shown in FIG. 7 and a frequency.

FIG. 7 shows another responding unit. The responding unit is a split ring resonator structure. This structure is a typical structure implementing negative permeability and negative refraction. FIG. 8 is a curve showing a response relationship between an equivalent refractive index of the split ring resonator and a frequency. When the equivalent refractive index is turned to a negative value from a positive value, frequency 0 is a resonance frequency f0. When the equivalent refractive index is turned to a positive value from a negative value, frequency 0 is a plasma frequency f1. To ensure that the equivalent refractive index is a positive value, a working frequency of a harmonic oscillator is required to be less than the resonance frequency f0 or is greater than the plasma frequency f1.

Therefore, for a responding unit for which a negative equivalent refractive index exists within an entire frequency range, to enable the responding unit to have a positive equivalent refractive index in an electromagnetic field corresponding to a working frequency of a harmonic oscillator, the working frequency of the harmonic oscillator should be lower than a resonance frequency of the responding unit or is higher than a plasma frequency of the responding unit.

When a curve showing a response relationship between an equivalent refractive index of the responding unit and a frequency has multiple resonance frequencies and plasma frequencies, the working frequency of the harmonic oscillator is less than a minimum resonance frequency, or greater than a maximum plasma frequency, or within a frequency range between a previous plasma frequency and a subsequent high-order resonance frequency of the plasma frequency.

A positive equivalent refractive index means that both a permittivity and permeability are positive value. A negative equivalent refractive index is obtained as long as one of the permittivity and permeability is a negative value. Applying a responding unit with a positive equivalent refractive index on a harmonic oscillator is equivalent to increasing an average permittivity of the harmonic oscillator. It is known that, a higher permittivity leads to a lower resonance frequency of a resonant cavity used by a harmonic oscillator and a smaller cavity volume when a same resonance frequency is implemented, thereby further implementing miniaturization.

Figure 9:
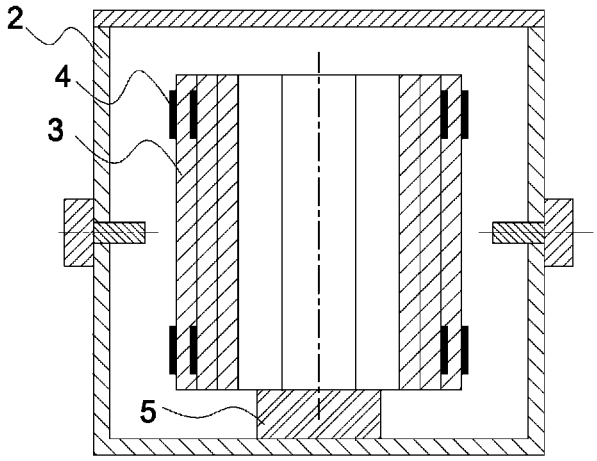
FIG. 9 is a schematic structural diagram of a cavity filter according to one embodiment.

Therefore, the disclosure further protects a cavity filter having the harmonic oscillator. As shown in FIG. 9, the cavity filter includes a resonant cavity 2 and the foregoing harmonic oscillator located within the resonant cavity 2. The cavity filter may be a band-pass filter, a band-stop filter, a high-pass filter, a low-pass filter, or a multi-band filter.

To simplify schematic description, the following only draws one resonant cavity and a harmonic oscillator within the resonant cavity. A person skilled in the art may easily think of that the cavity filter may have four resonant cavities, six resonant cavities, eight resonant cavities, or more resonant cavities. The harmonic oscillator in the disclosure may be disposed in one of the resonant cavities and a traditional dielectric harmonic oscillator or a metallic harmonic oscillator may be used in another cavity; or the harmonic oscillator in the disclosure may be used in several or all resonant cavities.

As shown in FIG. 9, the harmonic oscillator is preferably disposed in the center of the resonant cavity 2. The harmonic oscillator may also be directly disposed on a bottom surface of an inner surface of the resonant cavity 2.

Figure 10:
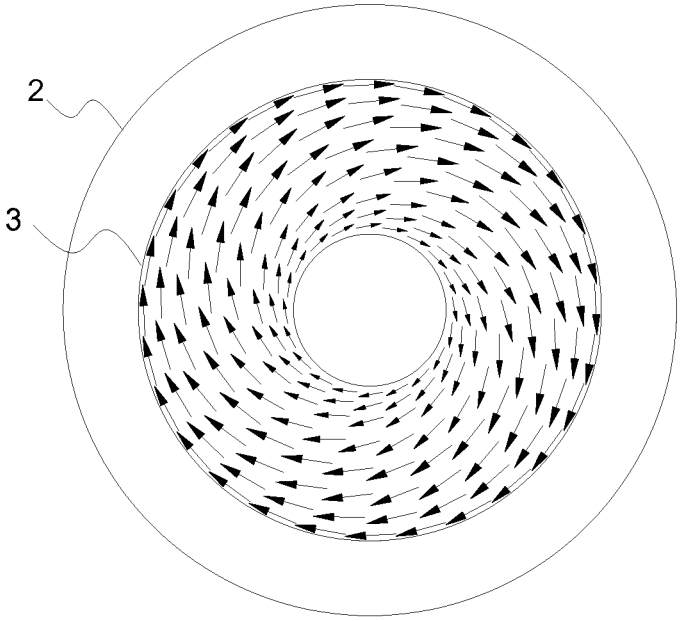
FIG. 10 is a magnetic field distribution diagram in a TM mode.
Figure 11:
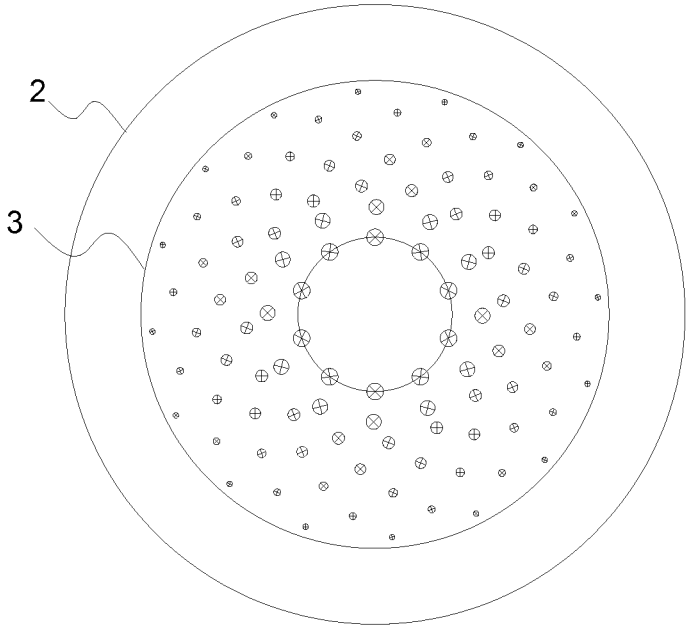
FIG. 11 is an electric field distribution diagram in a TM mode.

FIG. 10 shows a magnetic field distribution in a TM mode, where a direction and size of an arrow stand for a direction and size of magnetic field strength respectively. It may be known from FIG. 10 that a magnetic field horizontally encircles a central axis of a resonant cavity. FIG. 11 shows an electric field distribution in a TM mode, where ⊕ indicates that an electric field is vertical to a paper direction and a size of ⊕ indicates a size of electric field intensity.

Therefore, a center line encircled by the magnetic field is used as a central axis of the harmonic oscillator and a circle formed by any magnetic line is used as a cross section. One cylindrical surface is obtained by extending the circle along an electric field direction. A different cylindrical surface may be obtained for a magnetic line circle with a different radius. Therefore, a dielectric body of the harmonic oscillator has multiple coaxial cylindrical surfaces that are internally and externally nested, where each cylindrical surface corresponds to one magnetic field strength and one electric field intensity. One or more responding units are attached on at least one of the cylindrical surfaces.

Two most important parameters of the cavity filter are a resonance frequency and a Q value. The resonance frequency is related to an equivalent permittivity of the harmonic oscillator. Therefore, the responding unit is preferably disposed on one or more cylindrical surfaces whose electric field intensity is greater than a second preset value, so as to reach a maximum equivalent permittivity and maximally decrease a resonance frequency of the cavity filter, thereby reducing a volume of the resonant cavity when a same resonance frequency is implemented.

In a TM mode, there is one electric field intensity on each point of the harmonic oscillator and there is a maximum value in these electric field intensities. The second preset value is a value greater than the maximum value minus 0.5 dB.

The responding unit is located on the one or more cylindrical surfaces whose electric field intensity is greater than the second preset value, that is, the responding unit is located on one or more cylindrical surfaces whose diameter is less than a first preset value. Preferably, the first preset value is less than or equal to 90% of a sum of a diameter of an outermost cylindrical surface and a diameter of an innermost cylindrical surface in the multiple cylindrical surfaces of the foregoing harmonic oscillator. Preferably, the responding unit is directly located on one innermost cylindrical surface of the harmonic oscillator, where the cylindrical surface has a smallest diameter. In a longitudinal direction along an axis of a cylindrical surface, the responding unit may gradually decrease or increase, or may gradually decrease or increase from two ends to the middle at the same time. A responding unit on each cylindrical surface may be the same or may be different, which is not limited in the specification.

The following describes comparison with reference to specific experimental data.

In one cavity filter where a pure ceramic harmonic oscillator is located, an entire internal diameter, external diameter, and height of the harmonic oscillator are 6 mm, 24 mm, and 16 mm respectively. The harmonic oscillator does not have a responding unit. In a first mode, a measured resonance frequency of the cavity filter is 1.3075 GHz and a Q value is 10201.

Figure 12:
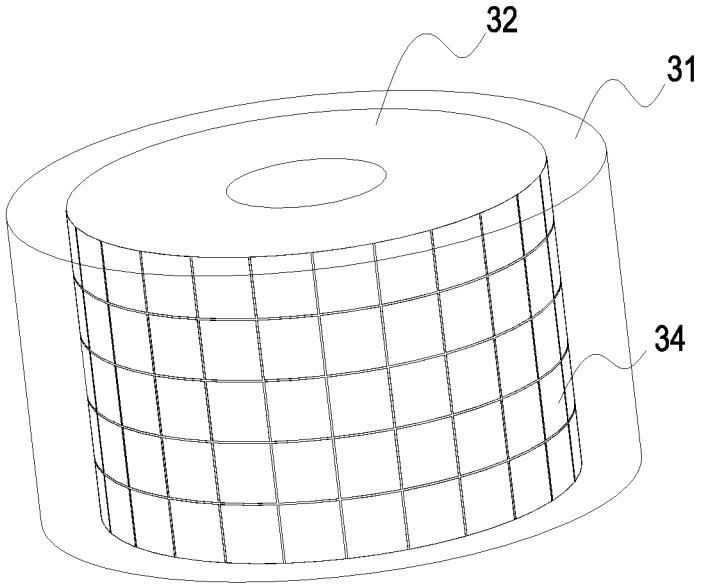
FIG. 12 is a schematic structural diagram when a responding unit is located on a cylindrical surface whose radius is relatively large.

In the foregoing harmonic oscillator and cavity filter, as shown in FIG. 12, other conditions keep unchanged, and the harmonic oscillator includes a first dielectric cylinder 31 and a second dielectric cylinder 32 that are internally and externally nested, where the first dielectric cylinder 31 and the second dielectric cylinder 32 separately have a cylindrical inner surface and a cylindrical outer surface. The responding unit is located on a cylindrical outer surface of the second dielectric cylinder 32. An external diameter of the second dielectric cylinder 32 is 20 mm. Each responding unit is quadrangular sheet metal that is flattened as a plane. In a first mode, a measured resonance frequency of the cavity filter is 1.1860 GHz and a Q value is 1379.

It may be seen from the foregoing comparison examples that disposing a responding unit on a cylindrical surface of a dielectric body may decrease a resonance frequency, for example, in the comparison example, the resonance frequency is decreased by 180 MHz but the loss of Q value is too large.

Figure 13:
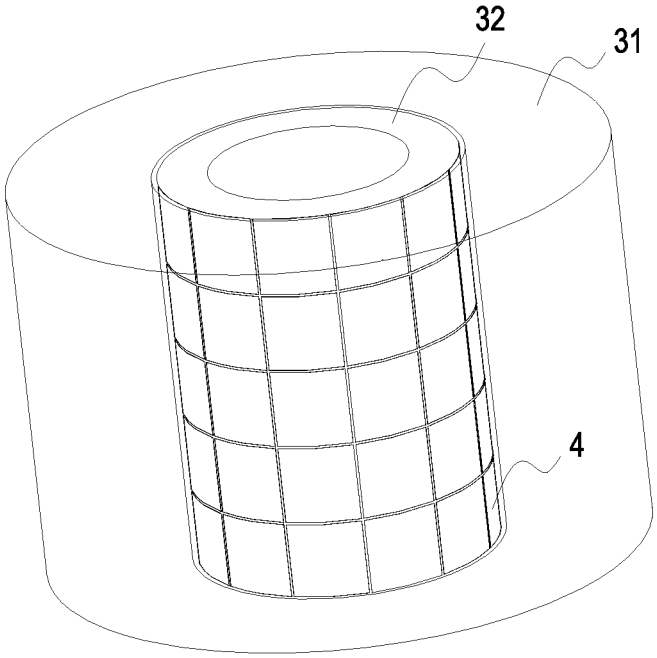
FIG. 13 is a schematic structural diagram when a responding unit is located on a cylindrical surface whose radius is relatively small.

In another embodiment, the external diameter of the second dielectric cylinder 32 is decreased to 8 mm, and the responding unit is also flattened as sheet metal that is the same as the sheet metal in the foregoing example. For arrangement, reference may be made to FIG. 13. In a first mode, a measured resonance frequency of the cavity filter is 0.9798 GHz and a Q value is 2887.

It can be seen that, when a responding unit is disposed at a location close to a central axis of a cylindrical surface, an obtained resonance frequency becomes lower while a Q value is relatively higher.

Figure 14:
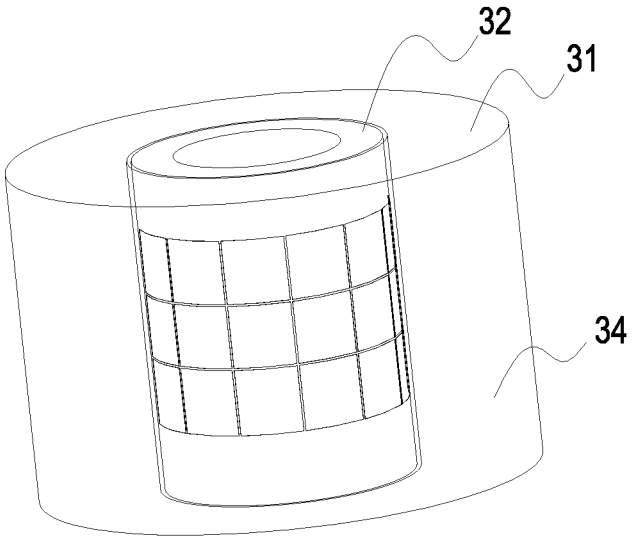
FIG. 14 is a schematic structural diagram when a responding unit is arranged on a cylindrical surface and the number of responding units is relatively small.

In order to further increase the Q value, the number of responding units may be properly reduced. For example, as shown in FIG. 14, based on the embodiment shown in FIG. 13, other conditions keep unchanged, and an upper row of responding units and a lower row of responding units are reduced. In this case, a measured resonance frequency of the cavity filter is 1.0896 GHz, and a Q value is 4626. Preferably, dimensions of a responding unit on each cylindrical surface decrease progressively as a diameter of the cylindrical surface increases.

In addition, in the disclosure, preferably, the responding unit 4 is an anisotropic structure. Anisotropy in the specification is opposite to isotropy. The isotropy means that a three-dimensional structure has three symmetry planes that are mutually perpendicular to each other, where the three-dimensional structure is symmetric based on any one symmetry plane, and meanwhile the three-dimensional structure is divided into eight completely same parts by the three symmetry planes, and a part coincides with a neighboring part after the part rotates by 90 degrees along a boundary line of any two symmetry planes. A structure that does not accord with such a requirement is an anisotropic structure. For example, a structure with a thin thickness and approximate to a plane is inevitably an anisotropic structure. However, the responding unit in the disclosure is preferably a structure approximate to a plane, and therefore is an anisotropic structure.

The disclosure further relates to an electromagnetic wave device having the foregoing cavity filter. The electromagnetic wave device may be all kinds of equipments that need to use a cavity filter, for example, an airplane, a base station, a radar, a satellite, and the like. These electromagnetic wave devices receive and send a signal, and perform filtering after receiving the signal or before sending the signal, so that the received or sent signal meets a demand. Therefore, the electromagnetic wave device further includes at least a signal transmitting module connected to an input end of the cavity filter and a signal receiving module connected to an output end of the cavity filter.

Figure 15:
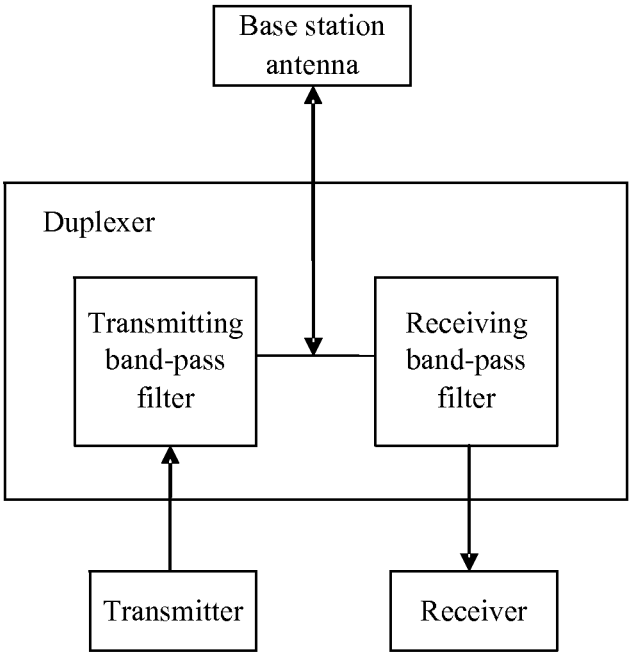
FIG. 15 is a schematic structural diagram when an electromagnetic wave device is a base station according to the disclosure.

For example, as shown in FIG. 15, the electromagnetic wave device is a base station. The base station includes a duplexer that is used as a filtering device. The duplexer includes a transmitting band-pass filter and a receiving band-pass filter. An input end of the transmitting band-pass filter is connected to a transmitter and an output end is connected to a base station antenna. An input end of the receiving band-pass filter is connected to the base station antenna and an output end is connected to a receiver.

For the transmitting band-pass filter, its signal transmitting module is a transmitter and its signal receiving module is a base station antenna. For the receiving band-pass filter, its signal transmitting module is a base station antenna and its signal receiving module is a receiver. At least one of the transmitting band-pass filter and the receiving band-pass filter is the foregoing cavity filter, which can effectively reduce a value of the duplexer and is further conducive to base station miniaturization.

In a word, the harmonic oscillator in the disclosure uses a responding unit to increase a permittivity, thereby effectively reducing a volume of a filter in a case of implementing a same resonance frequency. In addition, because the responding unit is attached onto a cylindrical surface, an eddy current loss is effectively reduced and even avoided, thereby avoiding decrease of a Q value due to introduction of a responding unit made from a conductive material.

The foregoing describes the embodiments of the disclosure with reference to the accompanying drawings. However, the disclosure is not limited to the foregoing specific implementation manners. The foregoing specific implementation manners are only for exemplary description and are not restrictive. Under enlightenment of the disclosure, a person of ordinary skill in the art may make various equivalent modifications or replacements without departing from the spirit of the disclosure and the protection scope of the claims, and these modifications or replacements should fall within the protection scope of the disclosure.

What is claimed is:

1. A harmonic oscillator, wherein the harmonic oscillator comprises:

a dielectric body; and at least one responding unit attached onto a surface of the dielectric body, wherein the responding unit is a conductive structure having a geometrical pattern;

the dielectric body has at least one cylindrical surface, the at least one responding unit is attached onto the at least one cylindrical surface, and the conductive structure having a geometrical pattern is made from a conductive material;

the responding unit has a positive equivalent refractive index in an electromagnetic field corresponding to a working frequency of the harmonic oscillator;

the dielectric body comprises multiple cylindrical dielectric cylinders that are internally and externally nested, wherein an inner surface and outer surface of each dielectric cylinder are both a cylindrical surface, and the responding unit is attached onto an inner surface or outer surface of at least one of the dielectric cylinders.

2. The harmonic oscillator according to claim 1, wherein the at least one responding unit comprises multiple responding units that are not electrically connected to each other.

3. The harmonic oscillator according to claim 1, wherein the at least one cylindrical surface comprises dielectric body has multiple coaxial cylindrical surfaces that are internally and externally nested, wherein one or more of the at least one responding unit are attached onto at least one of the cylindrical surfaces.

4. The harmonic oscillator according to claim 3, wherein the responding unit is located on one or more of the at least one cylindrical surface whose diameter is less than a first preset value, wherein the first preset value is less than or equal to 90% of a sum of a diameter of an outermost cylindrical surface and a diameter of an innermost cylindrical surface in more of the at least one cylindrical surface.

5. The harmonic oscillator according to claim 3, wherein the at least one cylindrical surface comprises multiple cylindrical surfaces, the responding unit is located on one innermost cylindrical surface in the multiple cylindrical surfaces; dimensions of the responding unit on each of the multiple cylindrical surfaces decrease progressively as a diameter of the cylindrical surface increases.

6. The harmonic oscillator according to claim 1, wherein the working frequency of the harmonic oscillator is higher than a plasma frequency of the responding unit or is lower than a subsequent high-order resonance frequency of the plasma frequency.

7. The harmonic oscillator according to claim 1, wherein dimensions of the responding unit are less than an electromagnetic wave wavelength corresponding to the working frequency of the harmonic oscillator.

8. The harmonic oscillator according to claim 1, wherein the dielectric body is made from a material with a permittivity greater than 1 and a loss angle tangent value less than 0.1.

9. The harmonic oscillator according to claim 1, wherein the responding unit gradually decreases or increases from two ends to the middle along an axial direction of the cylindrical surface.

10. The harmonic oscillator according to claim 1, wherein the responding unit is an anisotropic structure.

11. A cavity filter, comprising a resonant cavity and the harmonic oscillator according to any one of claim 1, wherein the harmonic oscillator is located within the resonant cavity.

12. The cavity filter according to claim 11, wherein a first mode of the cavity filter is a TM mode, and the responding unit is disposed on one or multiple cylindrical surfaces, wherein the one or more of the at least one cylindrical surface are formed respectively by extending one or multiple magnetic lines in the TM mode along an electric field direction.

13. The cavity filter according to claim 11, wherein the responding unit of the harmonic oscillator is located on one or more of the at least one cylindrical surface whose electric field intensity is between a maximum value of electric field intensity and the maximum value minus 0.5 dB.

14. The cavity filter according to claim 11, wherein the responding unit is located on one or more of the at least one cylindrical surface whose diameter is less than a first preset value, wherein the first preset value is less than or equal to 90% of a sum of a diameter of an outermost cylindrical surface and a diameter of an innermost cylindrical surface in the multiple cylindrical surfaces.

15. The cavity filter according to claim 11, wherein the cavity filter is a band-pass filter, a band-stop filter, a high-pass filter, a low-pass filter, or a multi-band filter.

16. An electromagnetic wave device, comprising a signal transmitting module, a signal receiving module, and the cavity filter according to any one of claim 11, wherein an input end of the cavity filter is connected to the signal transmitting module and an output end of the cavity filter is connected to the signal receiving module.

17. The electromagnetic wave device according to claim 16, wherein the electromagnetic wave device is a base station.

18. The electromagnetic wave device according to claim 17, wherein the base station comprises a duplexer, wherein the duplexer comprises a transmitting band-pass filter and a receiving band-pass filter, wherein at least one of the transmitting band-pass filter and the receiving band-pass filter is the cavity filter.

19. The electromagnetic wave device according to claim 16, wherein the electromagnetic wave device is an airplane, or a radar, or a satellite.

* * * * *